US006238230B1

(12) United States Patent
Sadler et al.

(10) Patent No.: US 6,238,230 B1
(45) Date of Patent: May 29, 2001

(54) LATCH ASSEMBLY AND CONNECTOR ASSEMBLY INCLUDING THE SAME

(75) Inventors: John T. Sadler, Wake Forest; Gregory S. Patterson, Morrisville, both of NC (US)

(73) Assignee: Telefonaktiebolaget L.M. Ericsson (SE)

( * ) Notice: Subject to any disclaimer, the term of this patent is extended or adjusted under 35 U.S.C. 154(b) by 0 days.

(21) Appl. No.: 09/639,222

(22) Filed: Aug. 15, 2000

(51) Int. Cl.[7] ..... H01R 13/627

(52) U.S. Cl. ..... 439/350; 439/357

(58) Field of Search ..... 439/350, 352, 439/353, 354, 357, 567

(56) References Cited

U.S. PATENT DOCUMENTS

| | | | | |
|---|---|---|---|---|
| 3,964,364 | * | 6/1976 | Poe | 85/72 |
| 4,630,983 | * | 12/1986 | Fischer | 411/15 |
| 4,830,556 | * | 5/1989 | Nelson | 411/41 |
| 4,861,208 | * | 8/1989 | Boundy | 411/339 |
| 5,848,456 | | 12/1998 | Sjöqvist | 24/618 |

* cited by examiner

*Primary Examiner*—Tulsidas Patel
(74) *Attorney, Agent, or Firm*—Myers Bigel Sibley & Sajovec

(57) ABSTRACT

A latch assembly includes a body member defining a cavity and including at least two spaced apart, opposed, relatively displaceable arms. A latch structure is located on at least one of the arms. A deformable elastomeric core is disposed in the cavity to resist convergent displacement of the arms. The elastomeric core is responsive to convergent displacement of the arms to provide a spring force biasing the arms apart.

29 Claims, 4 Drawing Sheets

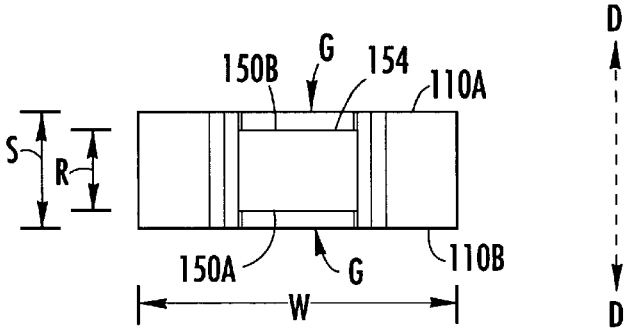
FIG. 5.
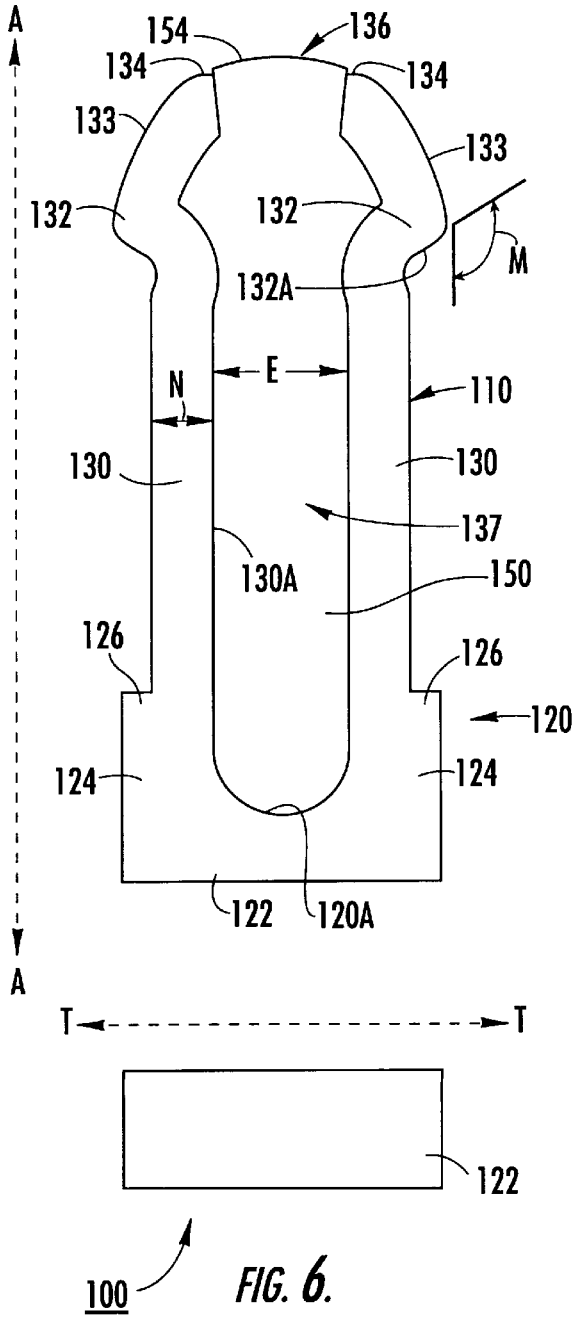
FIG. 3.
FIG. 6.
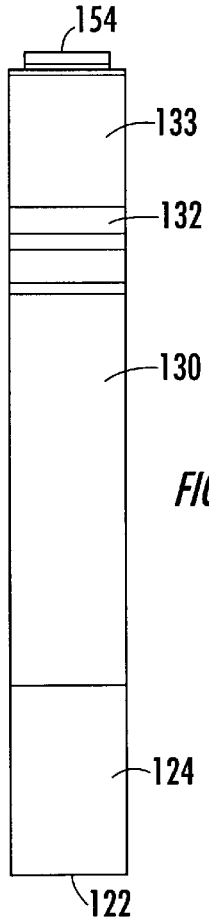
FIG. 4.

LATCH ASSEMBLY AND CONNECTOR ASSEMBLY INCLUDING THE SAME

FIELD OF THE INVENTION

The present invention relates to locking devices and, more particularly, to latches for securing connectors in engagement.

BACKGROUND OF THE INVENTION

Personal electronic devices such as radiotelephones and the like are becoming smaller and smaller. The reduction in the sizes of many components of these devices often results in a loss of strength and durability. Additionally, smaller devices tend to encourage portability and handling and, as a result, increased exposure to impacts and other stresses. Further, these smaller components may require greater dexterity to operate without damage.

Electrical connectors for personal electronic devices in particular have been steadily miniaturized to accommodate smaller housings, larger numbers of connector parts and aesthetic design demands. It is often very important that connectors such as electrical accessory connectors maintain a complete and reliable connection when in use. Unfortunately, such connectors are often subjected to repetitive, heavy-handed and, in some instances, damaging use by operators.

Latch mechanisms for securing connectors to personal electronic devices in particular are often subjected to abuse and repetitive use. The latch mechanisms should provide sufficient mechanical strength to keep the connector coupled to the device. For many applications, it is highly desirable that the latch mechanisms be of a passive locking design, i.e., allowing the user to disengage the connector by simply pulling it from an associated receptacle. However, passive locking latch mechanisms may be more prone to failure.

SUMMARY OF THE INVENTION

According to embodiments of the present invention, a latch assembly includes a body member defining a cavity and including at least two spaced apart, opposed, relatively displaceable arms. A latch structure is located on at least one of the arms. A deformable elastomeric core is disposed in the cavity to resist convergent displacement of the arms. The elastomeric core is responsive to convergent displacement of the arms to provide a spring force biasing the arms apart.

The latch structure may include a retention barb extending outwardly from at least one of the arms. Preferably, the elastomeric core is directly secured to the body member. The elastomeric core may be interposed between the arms.

According to embodiments of the present invention, a latch assembly includes a body member including first and second opposed arms. The arms are relatively movable from a first, spaced apart position to a second, more closely adjacent position. An elastomeric core is interposed between the arms such that, when the arms are moved from the first position to the second position, the elastomeric core is elastically deformed and exerts an expansive spring force biasing the arms to the first position. Preferably, the elastomeric core is directly secured to each of the arms. A latch structure may be located on at least one of the arms.

According to further embodiments of the present invention, an electrical connector assembly includes a connector body and an electrical contact mounted on the connector body. A latch assembly is mounted on the connector body. The latch assembly includes a body member defining a cavity and including at least two spaced apart, opposed, relatively displaceable arms. A latch structure is located on at least one of the arms. A deformable elastomeric core is disposed in the cavity to resist convergent displacement of the arms. The elastomeric core is responsive to convergent displacement of the arms to provide a spring force biasing the arms apart.

According to further embodiments of the present invention, an electrical connection assembly includes a receptacle and an electrical connector assembly. The receptacle includes a hole and a first electrical contact. The electrical connector assembly includes a connector body and a second electrical contact mounted on the connector body and adapted to engage the first electrical contact. A latch assembly is mounted on the connector body and is adapted to engage the receptacle. The latch assembly includes a body member defining a cavity and including at least two spaced apart, opposed, relatively displaceable arms. The arms are adapted for insertion into the hole of the receptacle. A latch structure is located on at least one of the arms. The latch structure is adapted to removably secure the latch assembly to the receptacle. A deformable elastomeric core is disposed in the cavity to resist convergent displacement of the arms. The elastomeric core is responsive to convergent displacement of the arms to provide a spring force biasing the arms apart.

According to further aspects of the present invention, a method of securing a latch assembly to a receptacle is provided. The latch assembly includes a body member defining a cavity and including at least two spaced apart, opposed, relatively displaceable arms, and further includes a deformable elastomeric core disposed in the cavity. The method includes inserting the arms into a hole in the receptacle such that the arms are compressed and the elastomeric core is thereby elastically deformed such that the elastomeric core exerts an expansion spring force on the arms. The method may include positioning the arms such that at least portions of the arms are disposed in the hole and a latch structure on at least one of the arms interlocks with a portion of the receptacle to resist removal of the latch assembly from the receptacle.

Objects of the present invention will be appreciated by those of ordinary skill in the art from a reading of the Figures and the detailed description of the preferred embodiments which follow, such description being merely illustrative of the present invention.

BRIEF DESCRIPTION OF THE DRAWINGS

FIG. 3 is a top view of the latch assembly of FIG. 1;

FIG. 4 is a side view of the latch assembly of FIG. 1;

FIG. 5 is a front end view of the latch assembly of FIG. 1;

FIG. 6 is a rear end view of the latch assembly of FIG. 1;

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to FIGS. 1–9, a latch assembly according to the present invention is shown therein and generally designated 100. The latch assembly 100 may be incorporated into a connector assembly 10 as shown in FIGS. 2 and 7–9. The latch assembly 100 may be used to removably secure the connector assembly 10 to an associated article such as an electronic device (e.g., a handheld radiotelephone). As will be appreciated by those of ordinary skill in the art upon reading the description herein, the latch assembly 100 may be substituted for latch mechanisms or locking devices such as those described in U.S. Pat. No. 5,848,456 to Sjöqvist and co-pending U. S. patent application Ser. No. 09/528,642, filed Mar. 20, 2000 (the disclosures of which are hereby incorporated herein by reference in their entireties), as well as other latching mechanisms that interconnect two components.

Figure 1:
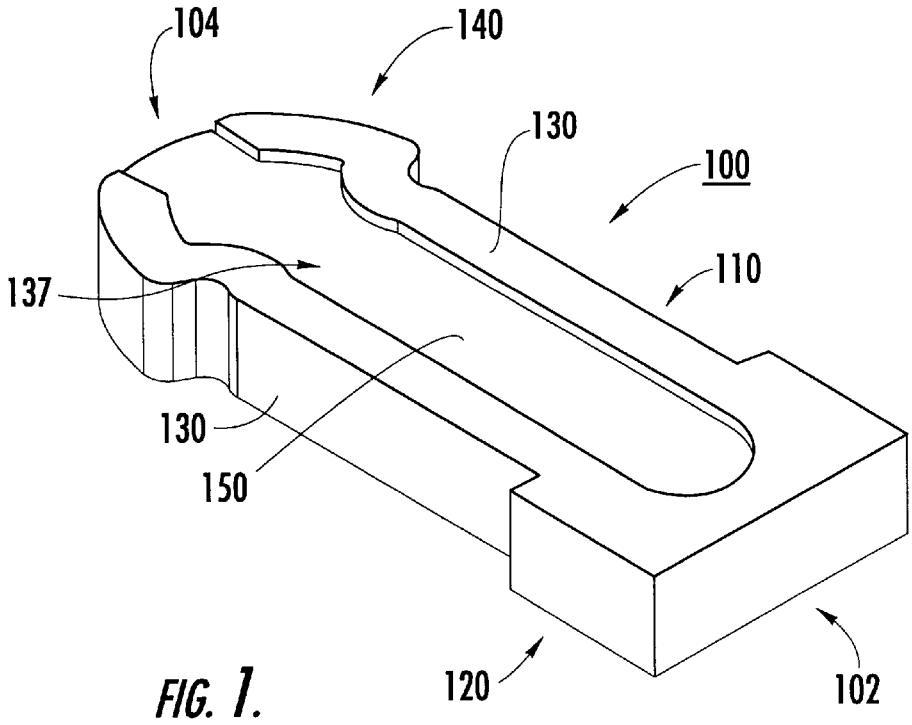
FIG. 1 is a perspective view of a latch assembly according to the present invention.

As best seen in FIG. 1, the latch assembly 100 extends along an insertion axis A—A (FIG. 3) between a base end 102 and a leading end 104. For the purposes of explanation, the latch assembly 100 further defines a first transverse axis T—T (FIG. 3) and a second, perpendicular transverse axis D—D (FIG. 5). Generally, the latch assembly 100 has a base portion 120 on the base end 102 and a latch head 140 on the leading end 104.

The latch assembly 100 includes a body member 110. The body member 110 is generally U-shaped and defines a cavity or channel 137 and an end opening 136 communicating with the cavity 137. As discussed in more detail below, an elastomeric core 150 is disposed in the cavity 137 and is secured to the body member 110. The elastomeric core 150 provides increased spring force to the latch assembly 100.

The body member 110 includes a pair of opposed side walls 124 and an end wall 122 extending between the side walls 124. A pair of opposed cantilever arms 130 extend from the side walls 124. The arms 130 and the side walls 124 form shoulders 126. Preferably, the arms 130 have a substantially uniform thickness N (see FIG. 3). Preferably, if the body member is formed of a thermoplastic, the nominal width E between the arms 130 is at least 1 millimeter, and, more preferably, is between about 1.2 and 1.6 millimeters.

Latch structures, more particularly outwardly extending barbs 132, are formed on the ends of the arms 130 adjacent the leading end 104. The barbs 132 include retention edges 132A. Preferably, the retention edges 132A each define an angle M with respect to the axis A—A of at least about 100 degrees, and more preferably of between about 100 and 130 degrees. The arms 130 further include inwardly tapered leading edges 133. The arms 130 terminate at respective ends 134 which define the opening 136.

Figure 8:
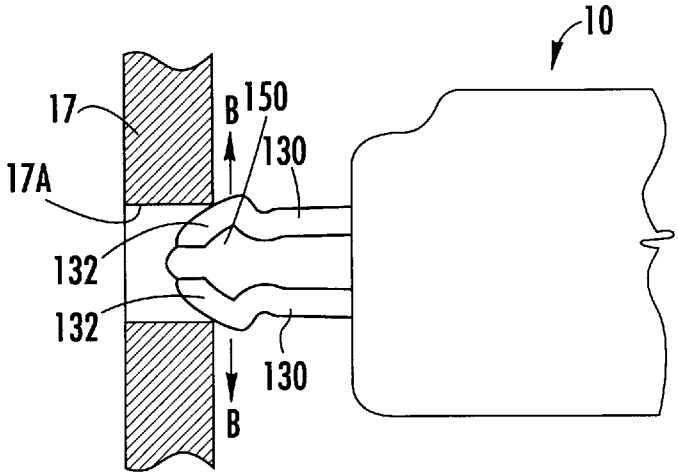
FIG. 8 is a fragmentary, side view of the connector assembly and the receptacle of FIG. 7, wherein the latch assembly is partially inserted into the receptacle.

At least a portion, and preferably all, of the body member 110 is formed of a deformable material to allow the arms 130 to be displaced or bent inwardly and outwardly (i.e., in a direction generally parallel to the axis T—T) between a relaxed position as shown in FIGS. 1–6 and a compressed position as shown in FIG. 8 without breaking. The body member 110 is preferably formed of a rigid or semi-rigid material which is able to sustain relatively large deflections without yielding. More preferably, the body member material has a Young's modulus of between about 778 and 3100 MPa. Preferably, the body member 110 is integrally formed. More preferably, the body member 110 is unitarily injection molded. However, the body member 110 may be formed from multiple pieces which are adhered, bonded or mechanically secured together. Preferably, the body member 110 is formed of a polymeric material, more preferably a thermoplastic. More preferably, the body member 110 is formed of nylon 6/6 (e.g., Stanyl TW341™ from DSM Engineering Plastics), polycarbonate (e.g., Lexan 101™ from General Electric), or a polycarbonate/copolymer blend (e.g., Ultem 1110F™ from General Electric). Alternatively, the body member 110 may be formed of metal.

Illustratively and as shown, the elastomeric core 150 extends continuously from the end wall 122 to a terminal end 154 of the elastomeric core 150 adjacent the opening 136. Preferably and as shown, the terminal end 154 is disposed forwardly beyond the body member 110. The elastomeric core 150 is bonded to the interior surfaces 120A of the walls 122, 124 and to the interior surfaces 130A of the arms 130.

The elastomeric core 150 is formed of a suitable elastomer. Preferably, the elastomeric core 150 is formed of a thermoplastic elastomer, and more preferably of a thermoplastic molding grade elastomer. Preferably, the elastomer has a durometer of at least Shore A of 20, more preferably of between about Shore A of 20 and Shore A of 65. Suitable and preferred materials include Santoprene™, a thermoplastic elastomer available from Advanced Elastomer Systems, and Hercuprene™ S2954-BX2, a thermoplastic elastomer available from Jvon/Hercuprene Thermoplastic Elastomers Products.

Preferably, the latch assembly 100 is formed using an injection molding process. More preferably, the latch assembly 100 is formed using a two-shot molding process whereby the body member 110 is first formed by injection molding, and the elastomeric core 150 is thereafter formed within the body member 110 by a second injection molding step. Preferably, the materials of the body member 110 and the elastomeric core 150 are selected such that the materials will sufficiently bond to one another. Additionally, additionally or alternatively, an adhesive may be employed to secure the elastomeric core 150 to the body member 110.

As best seen in FIGS. 1 and 5, in the illustrated preferred embodiment, the elastomeric core 150 does not entirely fill the cavity 137. With reference to FIG. 5, the thickness S of the body member 110 is greater than the corresponding thickness R of the elastomeric core 150. As a result, opposed expansion recesses G are defined between the outer surfaces 150A and 150B of the elastomeric core 150 and the adjacent outer surfaces 110A and 110B of the body member 110, respectively. Preferably, the thickness S is at least about 10 percent greater than the thickness R.

Figure 2:
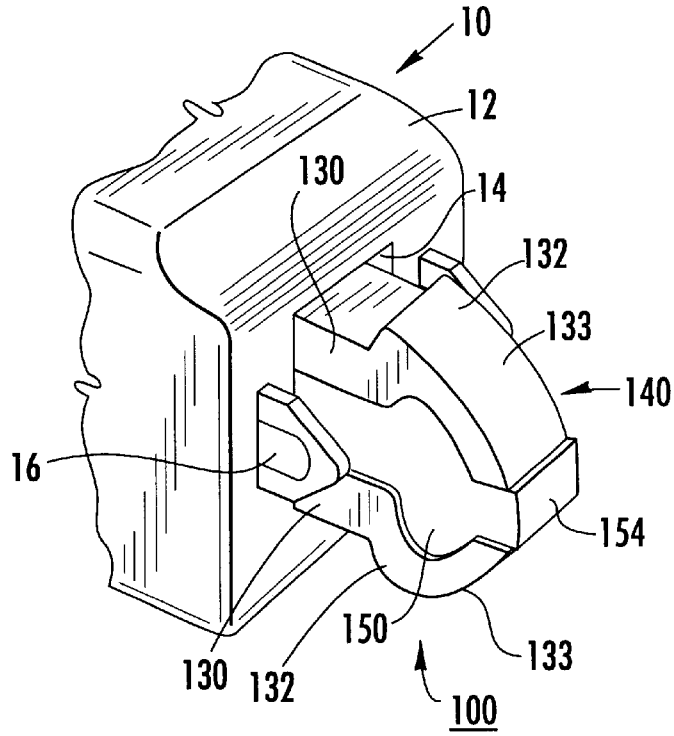
FIG. 2 is a perspective view of a connector assembly incorporating the latch assembly of FIG. 1.

With reference to FIG. 2, the connector assembly 10 is exemplary of the types of connector assemblies with which the latch assembly 100 may be employed. The connector assembly 10 includes a connector body 12. A passage 14 is formed in the connector body 12. The latch assembly 100 is secured in the connector body 12 such that the base portion 120 is mechanically keyed, adhered and/or bonded within the connector body 12 and the arms 130 extend through the passage 14 such that parts thereof, including the head 140, are exposed. An electrical lead 16 extends from the connector body 12 adjacent the latch assembly 100 and is preferably movable and outwardly spring biased such that the lead 16 may be pushed into the connector body 12.

Figure 7:
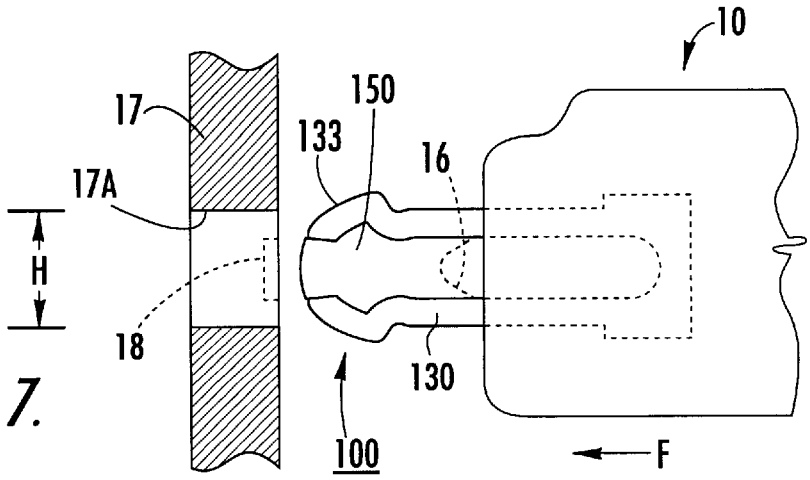
FIG. 7 is a fragmentary, side view of the connector assembly of FIG. 2 and an associated receptacle, wherein the connector assembly and the receptacle are shown prior to insertion of the connector assembly into the receptacle.
Figure 9:
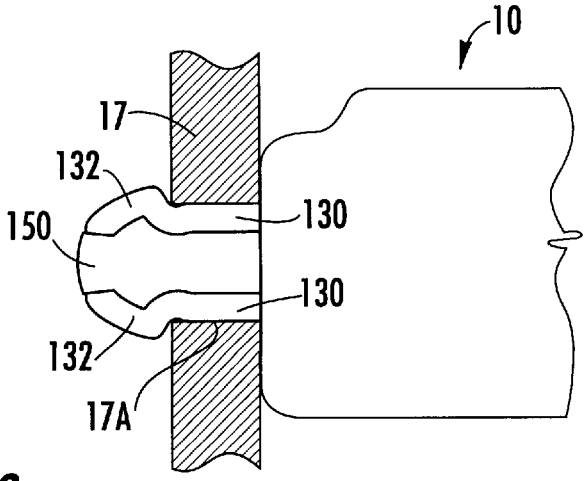
FIG. 9 is a fragmentary, side view of the connector assembly and the receptacle of FIG. 7, wherein the latch assembly is fully inserted into the receptacle and disposed in a latched position.

With reference to FIGS. 7–9, the connector assembly 10 and the latch assembly 100 may be used in the following manner and in cooperation with a receptacle 17 defining a hole 17A and having an electrical contact 18. The receptacle 17 may be, for example, a handheld radiotelephone or other personal electronic device.

FIGS. 7–9 illustrate the process for removably securing the connector assembly 10 to the receptacle 17 and, more particularly, the process for inserting the latch assembly 100 into the receptacle 17. In FIG. 7, the latch assembly 100 is shown being aligned with the receptacle opening 17A such that the leading edges 133 are positioned adjacent the edges of the opening 17A. The latch assembly 100 normally assumes the relaxed orientation as shown in FIG. 3 when no external forces are applied. The width H of the opening is less than the maximum width W (see FIG. 3) of the arms 130 in the relaxed position such that an insertion force in the direction F and along the axis A—A must be applied.

The semi-rigid body member 110 and, more particularly, the leading edges 133 provide bearing surfaces for guiding the latch assembly 100 into the hole 17A. As the latch assembly 100 is forced into the hole 17A, the sloped leading edges 133 engage the edges of the hole 17A. Upon applying the necessary insertion force and as the leading edges 133 enter the hole 17A, the arms 130 are compressed inwardly toward one another. The barbs 132 continue to contact and apply a spring force against the receptacle edges as the latch assembly 100 slides through the opening 17A.

Notably, in order to compress the arms 130 sufficiently to allow the barbs 132 to pass through the hole 17A, it is necessary to deflect one or both of the arms 130 and also to elastically deform the elastomeric core 150. Accordingly, the latch assembly 100 presents outward (i.e., expansion) spring forces in the directions as indicated by the arrows B (FIG. 8) which urge the arms 130 outwardly. The spring forces include the spring force resulting from the deflection of the arms 130 and also the spring force resulting from the deformation of the elastomeric core 150. Preferably, the elastomeric core 150 bulges outwardly parallel to the axis D—D and also outwardly along the axis A—A through the opening 136. The opposed cavities G (see FIG. 5) may be sized and configured to allow the elastomeric core 150 to bulge as necessary for insertion without the elastomeric core 150 significantly extending beyond the surfaces 110A, 110B so that the elastomeric core 150 does not significantly engage the surfaces surrounding the hole 17A.

Once the latch assembly 100 is fully inserted into the receptacle 17, the head 140 clears the hole 17A, thereby allowing the arms 130 to expand apart. The retention edges 132A of the barbs 132 engage and interlock with the interior surfaces of the receptacle 17 on either side of the hole 17A. The engagement surfaces of the receptacle 17 may be specially configured cooperative structures. The lead 16 is thereby maintained in contact with the contact 18 (see FIG. 7). Preferably, the components of the connector 10 and the receptacle 17 are relatively dimensioned such that the adjacent face of the connector body 12 contacts the receptacle 17. The body member 110 maintains the torsional rigidity of the latch assembly 100.

In order to remove the latch assembly 100 from the receptacle 17, the user must apply sufficient force to recompress the arms 130 so that the barbs 132 will clear the hole 17A. In order to do so, the user must apply sufficient pulling force to overcome the spring force of both the arms 130 and the elastomeric core 150. The required pulling force will also depend on the selected angle M of the retention edges 132A.

As will be appreciated from the foregoing, the latch assembly 100 may provide increased retention force as compared to a similar type latch assembly not incorporating an elastomeric core. Because the elastomeric core 150 may be relied upon to provide or supplement the physical spring force required to secure the latch assembly 100 to the receptacle 17, the configuration, construction and materials of the body member 110 may be selected to enhance other properties and functionality. For example, the body member 110 may be formed of a material of relatively low cost and/or exhibiting improved lubricity, wear resistance, stiffness, toughness, abrasion resistance, temperature resistance, dimensional stability, creep resistance, fatigue resistance and/or other desired mechanical properties. The body member 110 may be formed with less material.

The amount, configuration and properties of the elastomeric core 150 may be selected to provide the desired amount of spring force. For different applications, it may be desirable to modify the properties of the elastomeric core material to provide more or less retaining spring force while maintaining the same construction for the remainder of the latch assembly 100. Preferably, the elastomeric core 150 provides at least 20 percent of the total spring force to the latch assembly when the latch assembly is in the intended fully compressed position as shown in FIG. 8, and, more preferably, between about 30 and 80 percent. Preferably, the elastomeric core 150 provides at least 15 Newtons of this spring force, and more preferably between about 15 and 40 Newtons. The total spring force (from both the body member 110 and the elastomeric core 150) is preferably between about 50 and 70 Newtons.

Figure 10:
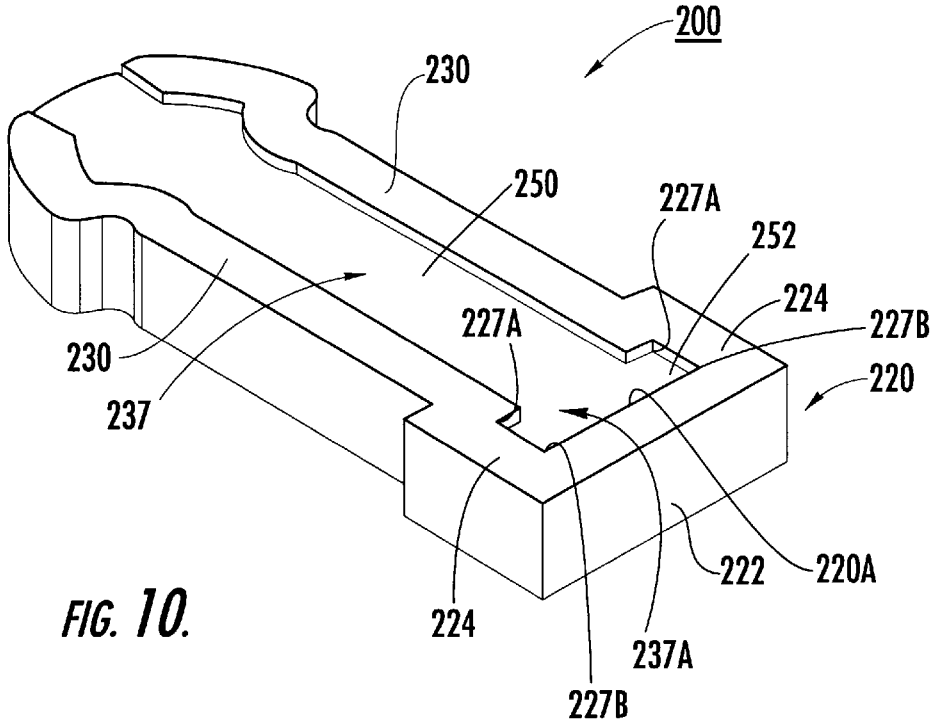
FIG. 10 is a perspective view of a latch assembly according to a further embodiment of the present invention.

With reference to FIG. 10, a latch assembly 200 according to a further embodiment of the present invention is shown therein. The latch assembly 200 is identical to the latch assembly 100 except that the base portion 220 and the elastomeric core 150 are differently formed. An end wall 222, opposed side walls 224, and arms 230 define a base cavity portion 237A having corners 227A and 227B. A base portion 252 of the elastomeric core 250 is disposed within the cavity portion 237A and is bonded to the interior surface 220A. The latch assembly 200 may be preferred over the latch assembly 100 in applications where additional securement between the elastomeric core and the body member is desired.

Figure 11:
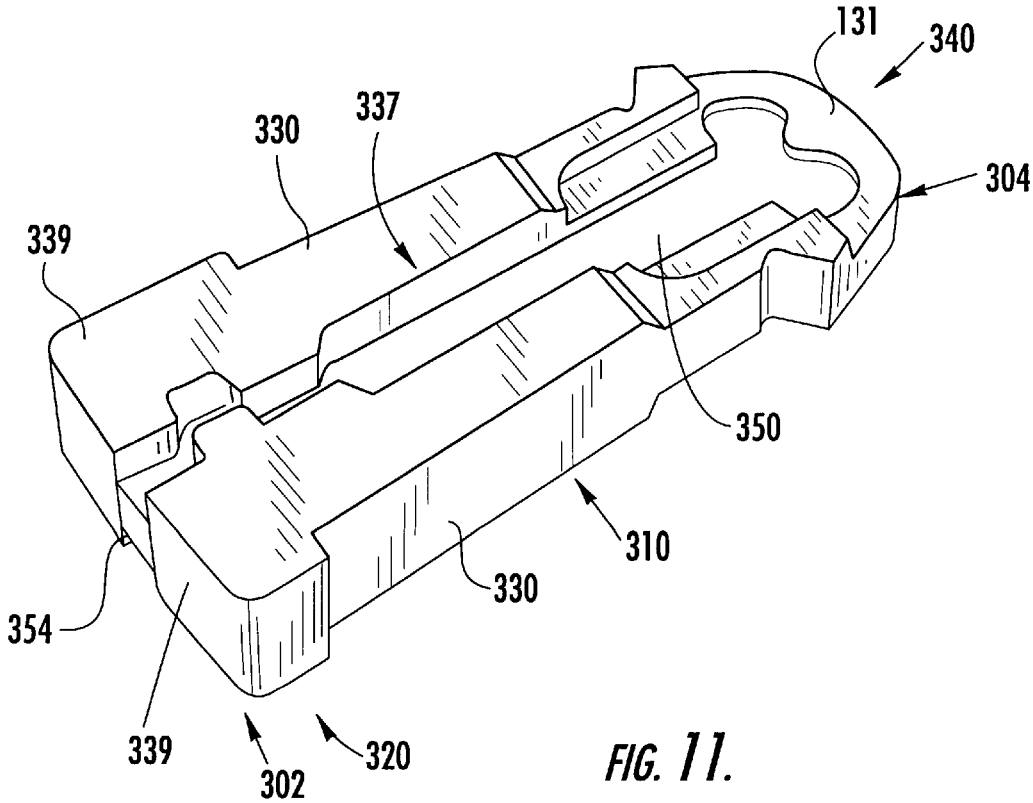
FIG. 11 is a perspective view of a latch assembly according to a further embodiment of the present invention.

With reference to FIG. 11, a latch assembly 300 according to a further embodiment of the present invention is shown therein. The latch assembly 300 includes a generally U-shaped body member 310 generally corresponding to the body member 110 and having a leading end 304 and a base end 302. However, the arms 330 of the body member 310 are connected by a connecting portion 131 at the head 340 and have respective free ends 339 at the base portion 320 of the latch assembly 300. The body member 310 defines a cavity 337 within which an elastomeric core 350 is bonded. The elastomeric core 350 extends from the head 340 to a terminal end 354 adjacent the base portion 320 as shown.

The preferred materials and methods for forming the body member 310, the elastomeric core 350 and the latch assembly 300 are preferably as described above with regard to the latch assembly 100. The latch assembly 300 may be incorporated into a connector assembly and removably secured to a receptacle in the manner described above with regard to the latch assembly 100.

It will be appreciated from the foregoing descriptions that the latch assemblies 100, 200, 300 may be modified in various ways. For example, the shapes and dimensions of the body members and the elastomeric cores may be modified. Latch structures other than or in addition to the outwardly extending retention barbs may be provided on one or both of the arms. Moreover, embodiments of the present invention may include various other configurations or features. For example, in accordance with the present invention, each of the embodiments as disclosed in U.S. Pat. No. 5,848,456 and co-pending U.S. patent application Ser. No. 09/528,642 may be provided with an elastomeric core corresponding to the elastomeric core 100.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A latch assembly comprising:

a) a body member defining a cavity and including at least two spaced apart, opposed, relatively displaceable arms;

b) a latch structure on at least one of said arms; and c) a deformable elastomeric core disposed in said cavity to resist convergent displacement of said arms and responsive to convergent displacement of said arms to provide a spring force biasing said arms apart.

2. The latch assembly of claim 1 wherein said latch structure includes a retention barb extending outwardly from at least one of said arms.

3. The latch assembly of claim 1 wherein said elastomeric core is directly secured to said body member.

4. The latch assembly of claim 3 wherein said elastomeric core is bonded to said body member.

5. The latch assembly of claim 1 wherein said elastomeric core is interposed between said arms.

6. The latch assembly of claim 1 wherein:

said body member is substantially U-shaped and includes a base portion;

said arms are joined to said base portion and extend from said base portion to respective distal free ends; and said cavity is defined at least in part by said base portion and said arms.

7. The latch assembly of claim 6 wherein said cavity includes an expanded cavity portion in said base portion and said elastomeric core includes a portion disposed in said expanded cavity portion and secured to an adjacent portion of the base portion.

8. The latch assembly of claim 1 having a leading end and a base end and wherein:

said latch structure is disposed adjacent said leading end;

said body member is substantially U-shaped;

said arms are joined to one another by a connecting portion on said leading end and extend from said connecting portion to respective distal free ends on said base end; and said cavity is defined at least in part by said connecting portion and said arms.

9. The latch assembly of claim 1 wherein body member is unitarily formed.

10. The latch assembly of claim 1 wherein said body member is formed of a polymeric material.

11. The latch assembly of claim 1 wherein said body member is formed of metal.

12. The latch assembly of claim 1 wherein said elastomeric core and said body member define at least one expansion recess in said cavity into which a portion of said elastomeric core may be displaced when said elastomeric core is deformed by convergent displacement of said arms.

13. A latch assembly comprising:

a) a unitarily formed body member defining a cavity and including at least two spaced apart, opposed, relatively displaceable arms;

b) a retention barb extending outwardly from at least one of said arms; and c) a deformable elastomeric core disposed in said cavity and interposed between said arms to resist convergent displacement of said arms and responsive to convergent displacement of said arms to provide a spring force biasing said arms apart, wherein said elastomeric core is directly secured to said arms;

d) wherein said elastomeric core and said body member define at least one expansion recess in said cavity into which a portion of said elastomeric core may be displaced when said elastomeric core is deformed by convergent displacement of said arms.

14. The latch assembly of claim 13 wherein said elastomeric core is bonded to said body member.

15. The latch assembly of claim 13 wherein:

said body member is substantially U-shaped and includes a base portion;

said arms are joined to said base portion and extend from said base portion to respective distal free ends; and said cavity is defined at least in part by said base portion and said arms.

16. The latch assembly of claim 15 wherein said cavity includes an expanded cavity portion in said base portion and said elastomeric core includes a portion disposed in said expanded cavity portion and secured to an adjacent portion of the base portion.

17. The latch assembly of claim 13 having a leading end and a base end and wherein:

said latch structure is disposed adjacent said leading end;

said body member is substantially U-shaped;

said arms are joined to one another by a connecting portion on said leading end and extend from said connecting portion to respective distal free ends on said base end; and said cavity is defined at least in part by said connecting portion and said arms.

18. The latch assembly of claim 13 wherein said body member is formed of a polymeric material.

19. The latch assembly of claim 13 wherein said body member is formed of metal.

20. A latch assembly comprising:

a) a body member including first and second opposed arms, said arms being relatively movable from a first, spaced apart position to a second, more closely adjacent position; and b) an elastomeric core interposed between said arms such that, when said arms are moved from said first position to said second position, said elastomeric core is elastically deformed and exerts an expansive spring force biasing said arms to said first position.

21. The latch assembly of claim 20 wherein said elastomeric core is directly secured to each of said arms.

22. The latch assembly of claim 20 including a latch structure on at least one of said arms.

23. The latch assembly of claim 20 wherein, when said arms are disposed in said second position, said expansive spring force is at least 15 Newtons.

24. The latch assembly of claim 20 wherein, when said arms are disposed in said second position, said latch assembly exerts a total expansive spring force biasing said arms to said first position and said expansive spring force of said elastomeric core is at least 20 percent of said total expansive spring force.

25. An electrical connector assembly comprising:

a) a connector body;

b) an electrical contact mounted on said connector body; and c) a latch assembly mounted on said connector body and comprising:

a body member defining a cavity and including at least two spaced apart, opposed, relatively displaceable arms;

a latch structure on at least one of said arms; and a deformable elastomeric core disposed in said cavity to resist convergent displacement of said arms and responsive to convergent displacement of said arms to provide a spring force biasing said arms apart.

26. An electrical connection assembly comprising:

a) a receptacle including a hole and a first electrical contact; and b) an electrical connector assembly comprising:

a connector body;

a second electrical contact mounted on said connector body adapted to engage said first electrical contact; and a latch assembly mounted on said connector body and adapted to engage said receptacle, said latch assembly comprising:

a body member defining a cavity and including at least two spaced apart, opposed, relatively displaceable arms, said arms adapted for insertion into said hole of said receptacle;

a latch structure on at least one of said arms, said latch structure adapted to removably secure said latch assembly to said receptacle; and a deformable elastomeric core disposed in said cavity to resist convergent displacement of said arms and responsive to convergent displacement of said arms to provide a spring force biasing said arms apart.

27. A method of securing a latch assembly to a receptacle, the latch assembly including a body member defining a cavity and including at least two spaced apart, opposed, relatively displaceable arms, the latch assembly further including a deformable elastomeric core disposed in the cavity, said method comprising the step of:

inserting the arms into a hole in the receptacle such that the arms are compressed and the elastomeric core is thereby elastically deformed such that the elastomeric core exerts an expansion spring force on the arms.

28. The method of claim 27 including the step of positioning the arms such that at least portions of the arms are disposed in the hole and a latch structure on at least one of the arms interlocks with a portion of the receptacle to resist removal of the latch assembly from the receptacle.

29. The method of claim 27 wherein said expansive spring force is at least 15 Newtons.

* * * * *